United States Patent [19]

Jacobs et al.

[11] Patent Number: 4,521,716

[45] Date of Patent: Jun. 4, 1985

[54] HIGH-PRESSURE METAL VAPOR DISCHARGE LAMP

[75] Inventors: Cornelis A. J. Jacobs; Johannes A. T. Schellen; Anthonius P. Van Der Vleuten, all of Eindhoven, Netherlands

[73] Assignee: U.S. Philips Corporation, New York, N.Y.

[21] Appl. No.: 416,533

[22] Filed: Sep. 9, 1982

[30] Foreign Application Priority Data

Sep. 17, 1981 [NL] Netherlands ..... 8104282

[51] Int. Cl.[3] ..... H01J 61/54

[52] U.S. Cl. ..... 313/594; 313/590

[58] Field of Search ..... 313/594, 595, 596, 601, 313/602, 607

[56] References Cited

U.S. PATENT DOCUMENTS 4,316,122 2/1982 Yamazaki et al. ..... 313/594 X

FOREIGN PATENT DOCUMENTS 44081 4/1977 Japan ..... 313/594

51775 4/1977 Japan ..... 313/594

117271 10/1978 Japan ..... 313/594

*Primary Examiner*—David K. Moore

*Assistant Examiner*—K. Wieder

*Attorney, Agent, or Firm*—Robert S. Smith

[57] ABSTRACT

The invention relates to a high-pressure metal vapor discharge lamp having an ignition auxiliary means (13) externally of the discharge vessel. The external ignition auxiliary means is connected electrically to a first main electrode (5) and in the inoperative condition of the lamp extends along the wall of the discharge vessel up to at most 3 mm beyond one end of a second main electrode (6). According to the invention the external ignition element extends at the level of the first main electrode over at most 3 mm along the first main electrode from the end of the first main electrode. In this manner a regular ignition of the lamp is obtained, variation in the ignition voltage pulse required for ignition being considerably restricted.

6 Claims, 1 Drawing Figure

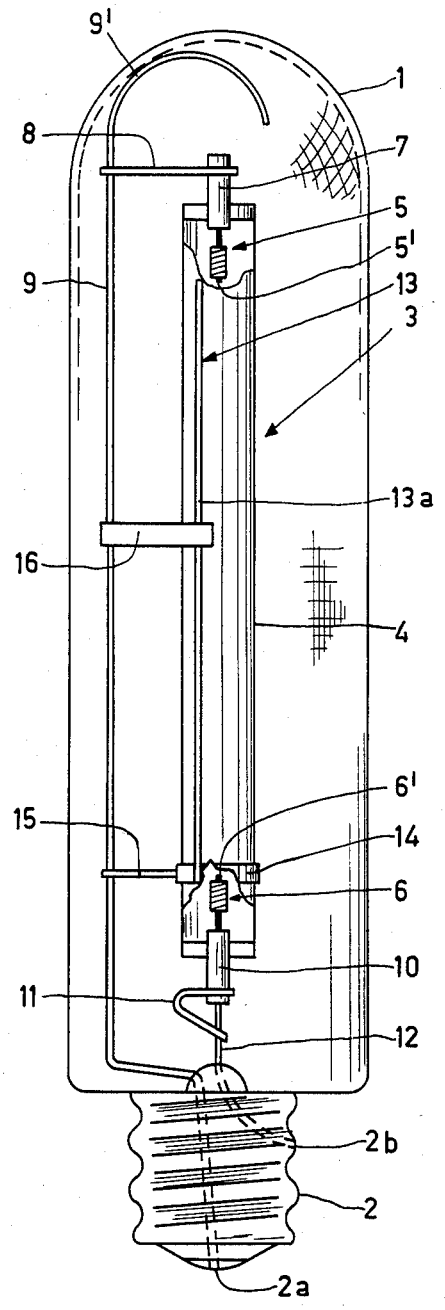
9'
1
8
7
5
5'
9
13
3
13 a
16
4
6'
15
14
6
10
11
12
2 b
2
2 a

HIGH-PRESSURE METAL VAPOR DISCHARGE LAMP

The invention relates to a high-pressure metal vapor discharge lamp having a discharge vessel comprising a radiation-transmitting wall and a first and a second main electrode between which in the operative condition of the lamp the discharge takes place, which main electrodes each have an end which is directed toward the discharge, the discharge vessel furthermore comprising an external ignition auxiliary means which in the operative condition of the lamp is connected electrically to the first main electrode and extends from the end of the first main electrode up to the end of the second main electrode or up to at most 3 mm beyond said end, and is also present at a distance of at most 1 mm from the wall of the discharge vessel and at least near the second main electrode tightly engages said wall.

Such a lamp is known from Netherlands Patent Application 7907437. It has been found that the known lamp has a good ignition when the condition is satisfied that the external ignition auxiliary means extends along the wall of the discharge vessel up to the end of the second main electrode or up to at most 3 mm beyond said end. A second condition for good igniting is that the external ignition auxiliary means is present at a distance of at most 1 mm from the wall of one discharge vessel and engages said wall at least near the second main electrode. It has been found, however, that the known lamp often ignites irregularly, that is to say that the value of the ignition voltage pulse required for igniting varies considerably for each individual lamp.

It is the object of the invention to provide a means with which such irregular ignition is avoided.

According to the invention a lamp of the kind mentioned in the opening paragraph is characterized in that, at the area of the first main electrode and measured from the end of the first main electrode the external ignition auxiliary means axially the first main electrode over at most 3 mm.

Lamps according to the invention have been found to have a very regular ignition in which the variation in the required value of the ignition voltage pulse is considerably restricted.

It has been found that the following stages can be distinguished when igniting a high-pressure metal vapor discharge lamp according to the invention:

An auxiliary discharge is formed between the second main electrode and the wall of the discharge vessel near said main electrode and directed towards the external ignition auxiliary means the auxiliary discharge then expands along the wall of the discharge vessel into the proximity of the first main electrode and directed towards the external ignition auxiliary means the auxiliary discharge finally jumps from the wall of the discharge vessel to the first main electrode after which the auxiliary discharge evolves into a stable arc discharge and the operative condition of the lamp is thus reached. The various stages occur under the influence of the so-called ignition voltage pulse which is applied between the two main electrodes.

The metallic components of the filling of such lamps will be condensed in the inoperative condition of the lamp. A place for the said condensate occurring very frequently in practical cases is the part of the discharge vessel which, viewed from the place where in the operative condition of the lamp the discharge takes place, lies behind a main electrode.

In the case of the known lamp it has been found that the auxiliary discharge in many cases directly affects the condensate. The voltage required for jumping of the auxiliary discharge from the condensate to the adjacent main electrode is particularly high in such situations. As a result of this the ignition of the lamp is badly reproducible. It has surprisingly been found that in lamps according to the invention the auxiliary discharge in substantially all cases directly attacks the main electrode with which a readily reproducible ignition of the lamp is obtained.

The external ignition auxiliary means may be constructed, for example, as a wire wound around the discharge vessel or as a strip secured to the discharge vessel.

In an advantageous embodiment of a lamp according to the invention a strip-shaped part of the external ignition auxiliary means in the inoperative condition of the lamp near the second main electrode tightly engages the wall of the discharge vessel at least over half the circumference.

It has been found with this embodiment that the variation in the value of the ignition voltage pulse required for igniting is even further restricted then it would be under otherwise the same circumstances. This may be explained as follows. The ignition voltage required for igniting the lamp will be determined by the formation of an auxiliary discharge over the track having the largest electric field strength, that is having the largest voltage gradient. In ideal circumstances this track will be formed by that point of the second main electrode which has the smallest distance to a point of the external ignition auxiliary means. In practical circumstances, factors such as local inhomogeneities of the main electrode, the discharge vessel wall, and the auxiliary means as well as the instantaneous composition of the gaseous filling of the discharge vessel at the area of the main electrode also play a role in addition to the distance. This leads to a spreading in the voltage gradient required for the formation of the auxiliary discharge between external ignition auxiliary means and second main electrode and in turn in a spreading in the ignition voltage pulse required for the igniting with other relevant factors being the same in otherwise the same circumstances. The control of these factors is only partly possible. However, by giving the external ignition auxiliary means a comparatively large spatial extent near the second main electrode, the influence of the said factors on the spreading in the required ignition voltage pulse can be restricted. It has been found that the spreading in the required ignition voltage pulse can be very considerably restricted already with a spatial extent of the external ignition auxiliary means in the form of a tight engagement over half the circumference against the wall of the discharge vessel by the ignition auxiliary means.

In the inoperative condition of the lamp the external ignition auxiliary means in a lamp in accordance with the invention advantageously tightly engages the wall of the discharge vessel over a length of at least half the distance between the ends of the main electrodes taken from the second electrode. Herewith it is achieved in a simple manner that during igniting of the lamp an expansion is promoted in the direction of the first electrode of the auxiliary discharge formed between the second main electrode and the wall of the discharge vessel.

In a further embodiment of a lamp in accordance with the invention the external ignition auxiliary means comprises a part which is movable with respect to the discharge vessel and which in the inoperative condition of the lamp extends along the wall of the discharge vessel between the ends of the main electrodes and in the operative condition of the lamp is remote from the wall of the discharge vessel. An advantage of this structure is that the part of the radiation emitted by the lamp in the operative condition of the lamp and intercepted by the external ignition auxiliary means is restricted. In addition, migration, if any, of constituents of the filling of the discharge vessel through the wall of the vessel under the influence of electric field strength which is caused by voltage differences between the discharge and the external ignition auxiliary means in the operative condition of the lamp is counteracted in this manner.

In a further improved embodiment the strip-shaped part is advantageously rigidly connected to the discharge vessel and in the inoperative condition of the lamp the electric connection between the strip-shaped part and the movable part of the external ignition auxiliary means has an ohmic resistance of at most 100Ω. It has surprisingly been found that the expansion of the point of attack of the auxiliary discharge along the wall of the discharge vessel from the strip-shaped part in the direction of the first main electrode is not detrimentally influenced in the case of an ohmic resistance value realised in this manner.

The invention is suitable for use both in high-pressure metal vapor discharge lamps having a discharge vessel with a ceramic wall (for example, polycrystalline densely sintered aluminum oxide or sapphire) and in smaller lamps having a discharge vessel formed from quartz or from hard glass. In addition to one or more metals, for example sodium and mercury, and one or more rare gases, for example xenon, the filling of the discharge vessel may also comprise halides.

An embodiment of a lamp in accordance with the invention will be described in greater detail with reference to a drawing.

In the drawing, reference numeral 1 denotes an outer envelope of a lamp according to the invention having a lamp cap 2. Inside the outer envelope is present a discharge vessel 3 shown partly broken away having a radiation-transmitting wall 4. The discharge vessel 3 has a first main electrode 5 and a second main electrode 6. Each of the main electrodes 5,6 has respective ends 5' and 6' which face the discharge which takes place in the operative condition of the lamp. Main electrode 5 is connected to a rigid current supply conductor 9 via a leadthrough conductor 7 and a current conductor 8. The rigid current supply conductor 9 is connected at one end to a first connection contact 2*a* of the lamp cap 2 while another end in the form of a supporting brace 9' bears against the outer envelope. Main electrode 6 is connected electrically to a current supply conductor 12 by means of a leadthrough conductor 10 and a flexible electrically conductive wire 11, which conductor 12 is mechanically connected directly to the leadthrough conductor 10. The rigid current supply conductor 12 is connected to a second connection contact 2*b* of the lamp cap 2.

The discharge vessel 3 has an external ignition auxiliary means 13 which comprises a movable part 13*a* and a strip-shaped part 14 provided at the axial position of the second main electrode 6. The strip-shaped part 14 and therewith the movable part 13*a* in the inoperative condition of the lamp is connected electrically to the first main electrode 5 by means of a conductor 15. The movable part 13*a* of the external ignition auxiliary means 13 finally is connected to the rigid current supply conductor 9 by means of a bimetal plate 16.

The lamp described has a discharge vessel 3 with ceramic wall 4 made from densely sintered aluminum oxide. The main electrodes 5 and 6 are made from tungsten while the leadthrough members 7 and 10 are in the form of niobium sleeves. The movable part 13*a* of the external ignition auxiliary means is a tungsten rod having a diameter of 0.4 mm which in the inoperative condition of the lamp bears against the wall 4 of the discharge vessel and against the strip-shaped part 14 under the influence of the bimetal plate 16. The strip-shaped part 14 of the ignition auxiliary means is preferably a niobium strip having a width of 3 mm which is provided against the wall of the discharge vessel over its whole circumference, for example by means of clamping or spot welding. Other suitable materials for the strip-shaped part are inter alia molybdenum, tantalum and titanium. The discharge vessel has a filling comprising 10 mg of amalgam of which 81.6% by weight of mercury and 18.4% by weight of sodium. In addition to mercury and sodium the discharge vessel comprises xenon which at approximately 300 K has a pressure of 80 kPa. The lamp is suitable for operation at an alternating voltage source of 220 V, 50 Hz by means of a stabilisation ballast of 600 mH. The power consumed by the lamp in the operative condition is 70 W.

In the inoperative condition of the lamp described the movable part 13*a* extends from the external ignition auxiliary means 13 along the discharge vessel and tightly engages the wall of the discharge vessel over substantially its full length. At the axial position of the first main electrode the movable part extends along the first main electrode over a length of approximately 2 mm taken from the end of the first main electrode.

At the axial position of the second main electrode the movable part 13*a* extends up to 2 mm beyond the end of the second main electrode 13*a* and in the inoperative condition of the lamp bears against the strip-shaped part 14. Said strip-shaped part 14 axially overlaps the second main electrode over approximately 2 mm measured from the end of the electrode.

It has been found that the ignition voltage pulse of some twenty lamps which are identical to the lamp described is on an average 2100 volts. The range in the value of the required ignition voltage pulse is approximately 200 volts. In comparable lamps having an external auxiliary means according to the prior art the required ignition voltage pulse varies from 2100 volts to 3500 volts.

What is claimed is:

1. A high-pressure metal vapor discharge lamp having a discharge vessel comprising a radiation-transmitting wall and first and second main electrodes between which in the operative condition of the lamp the discharge takes place, said main electrodes each having an end directed towards the discharge, the discharge vessel furthermore comprising an external ignition auxiliary means which in the inoperative lamp condition the lamp is connected electrically to said first main electrode and extends from the end of said first main electrode or axially overlaps no more than 3 mm thereof and extends axially to the end of said second main electrode or to axially overlaps no more than 3 mm thereof, and is also present at a distance of at most 1 mm from the wall of the discharge vessel, said external ignition auxiliary means having the portion thereof near said second main electrode tightly engaging said wall, said external ignition auxiliary means includes a strip-shaped part, disposed proximate to said second main electrode, which in the inoperative condition of said lamp said strip-shaped part of the external ignition auxiliary means tightly engages said wall of said discharge vessel over at least half the circumference thereof, said external ignition auxiliary means comprising a part which is movable with respect to said discharge vessel and which in the inoperative condition of the lamp extends along the wall of said discharge vessel between the ends of said main electrodes and in the operative condition of said lamp is remote from said wall of said discharge vessel.

2. A high-pressure metal vapor discharge lamp having a discharge vessel comprising a radiation-transmitting wall and first and second main electrodes between which in the operative condition of the lamp the discharge takes place, said main electrodes each having an end directed towards the discharge, the discharge vessel furthermore comprising an external ignition auxiliary means which in the inoperative lamp condition the lamp is connected electrically to said first main electrode and extends from the end of said first main electrode or axially overlaps no more than 3 mm thereof and extends axially to the end of said second main electrode or to axially overlaps no more than 3 mm thereof, and is also present at a distance of at most 1 mm from the wall of the discharge vessel, said external ignition auxiliary means having the portion thereof near said second main electrode tightly engaging said wall, said external ignition auxiliary means includes a strip-shaped part, disposed proximate to said second main electrode, which in the inoperative condition of said lamp said strip-shaped part of the external ignition auxiliary means tightly engages said wall of said discharge vessel over at least half the circumference thereof, said external ignition auxiliary means in the inoperative condition of the lamp tightly engaging the wall of the discharge vessel over a length of at least half the distance between the ends of said main electrodes measured from said second main electrode, said external ignition auxiliary means comprises a part which is movable with respect to said discharge vessel and which in the inoperative condition of the lamp extends along the wall of said discharge vessel between the ends of said main electrodes and in the operative condition of said lamp is remote from said wall of said discharge vessel.

3. A lamp as claimed in claim 2, characterized in that the strip-shaped part is rigidly connected to the discharge vessel and that in the inoperative condition of the lamp the electric connection between the strip-shaped part and the movable part of the external ignition auxiliary means has an ohmic resistance of at most 100 Ohms.

4. A lamp as claimed in claim 1, characterized in that the strip-shaped part is rigidly connected to the discharge vessel and that in the inoperative condition of the lamp the electric connection between the strip-shaped part and the movable part of the external ignition auxiliary means has an ohmic resistance of at most 100 Ohms.

5. A lamp as claimed in claim 2, characterized in that the strip-shaped part is rigidly connected to the discharge vessel and that in the inoperative condition of the lamp the electric connection between the strip-shaped part and the movable part of the external ignition auxiliary means has an ohmic resistance of at most 100 Ohms.

6. A high-pressure metal vapor discharge lamp having a discharge vessel comprising a radiation-transmitting wall and first and second main electrodes between which in the operative condition of the lamp the discharge takes place, said main electrodes each having an end directed towards the discharge, the discharge vessel furthermore comprising an external ignition auxiliary means which in the inoperative lamp condition the lamp is connected electrically to said first main electrode and extends from the end of said first main electrode or axially overlaps no more than 3 mm thereof and extends axially to the end of said second main electrode or to axially overlaps no more than 3 mm thereof, and is also present at a distance of at most 1 mm from the wall of the discharge vessel, said external ignition auxiliary means having the portion thereof near said second main electrode tightly engaging said wall, said external ignition auxiliary means includes a strip-shaped part, disposed proximate to said second main electrode, which in the inoperative condition of said lamp said strip-shaped part of the external ignition auxiliary means tightly engages said wall of said discharge vessel over at least half the circumference thereof, wherein said external ignition auxiliary means comprises a part which is movable with respect to said discharge vessel and which in the inoperative condition of the lamp extends along and at least partly is in contact with the wall of said discharge vessel between the ends of said electrodes and in the operative condition of said lamp is remote from said wall of said discharge vessel.

* * * * *

UNITED STATES PATENT AND TRADEMARK OFFICE

CERTIFICATE OF CORRECTION

PATENT NO. : 4,521,716

DATED : June 4, 1985

INVENTOR(S) : CORNELIS A. J. JACOBS ET AL

It is certified that error appears in the above-identified patent and that said Letters Patent is hereby corrected as shown below:

IN THE CLAIMS:

Claim 1, line 8, change "lamp condition" to --condition of--;

line 13, after "or" delete "to";

line 18, change "includes" to --including--;

line 20, delete "which";

line 22, change "engages" to --engaging--;

Claim 2, line 8, change "lamp condition" to --condition of--;

line 13, after "or" delete "to";

line 18, change "includes" to --including--;

line 20, delete "which";

line 22, change "engages" to --engaging--;

line 29, change "comprises" to --comprising--

UNITED STATES PATENT AND TRADEMARK OFFICE

CERTIFICATE OF CORRECTION

PATENT NO. : 4,521,716

DATED : June 4, 1985

INVENTOR(S) : CORNELIS A. J. JACOBS ET AL

It is certified that error appears in the above-identified patent and that said Letters Patent is hereby corrected as shown below:

Claim 6, line 8, change "lamp condition" to --condition of--;

line 13, after "or" delete "to";

line 18, change "includes" to --including--;

line 20, delete "which";

line 22, change "engages" to --engaging--.

Signed and Sealed this

*Third* Day of *December 1985*

[SEAL]

*Attest:*

DONALD J. QUIGG

*Attesting Officer*

*Commissioner of Patents and Trademarks*